US007074753B2

(12) United States Patent
Gallotti et al.

(10) Patent No.: US 7,074,753 B2
(45) Date of Patent: Jul. 11, 2006

(54) LIQUID SOFTENERS

(75) Inventors: Manlio Gallotti, Sao Paulo (BR); George Nunes, Santos (BR)

(73) Assignee: Clariant International Ltd., Muttenz (CH)

( * ) Notice: Subject to any disclaimer, the term of this patent is extended or adjusted under 35 U.S.C. 154(b) by 120 days.

(21) Appl. No.: 10/755,059

(22) Filed: Jan. 9, 2004

(65) Prior Publication Data

US 2004/0198632 A1 Oct. 7, 2004

Related U.S. Application Data

(63) Continuation-in-part of application No. 10/201,097, filed on Jul. 23, 2002, now abandoned.

(30) Foreign Application Priority Data

Jul. 28, 2001 (EP) ..... 01117767.2

(51) Int. Cl.
*C11D 1/94* (2006.01)

(52) U.S. Cl. ..... 510/496; 510/522; 510/527

(58) Field of Classification Search ..... 510/522, 510/527, 504, 496
See application file for complete search history.

(56) References Cited

U.S. PATENT DOCUMENTS

| | | | | |
|---|---|---|---|---|
| 4,259,215 | A | 3/1981 | Murata et al. | |
| 4,264,457 | A | 4/1981 | Beeks et al. | |
| 4,284,532 | A | 8/1981 | Leikhim et al. | |
| 4,333,862 | A * | 6/1982 | Smith et al. | 510/341 |
| 4,338,204 | A * | 7/1982 | Spadini et al. | 510/301 |
| 4,561,998 | A | 12/1985 | Wertz et al. | |
| 5,466,394 | A | 11/1995 | de Buzzaccarini et al. | |
| 5,798,329 | A | 8/1998 | Taylor et al. | |
| 5,880,086 | A | 3/1999 | Weinelt et al. | |
| 5,997,584 | A * | 12/1999 | Andersen et al. | 8/137 |

FOREIGN PATENT DOCUMENTS

| | | |
|---|---|---|
| EP | 0294894 | 12/1988 |
| EP | 1162254 | 12/2001 |

* cited by examiner

*Primary Examiner*—John R. Hardee
(74) *Attorney, Agent, or Firm*—Richard P. Silverman

(57) ABSTRACT

A liquid softener composition suitable for treatment of clothes and/or fabrics, composed by a) anionic surfactants of the formula $R—O-(AO)_n—SO_3^- M^+$ in the range of 1 to 20% b) a cationic surfactant or association of cationic surfactants in the range of 1 to 40% c) optionally amphoteric and/or non-ionic surfactants in the range of 0.1 to 20%; wherein the cationic compounds and anionic surfactants are present in a weight ratio of 1.5:1 to 19:1 (cationics/anionics).

9 Claims, No Drawings

LIQUID SOFTENERS

This is a continuation-in-part of U.S. application Ser. No. 10/201,097, filed Jul. 23, 2002, now abandoned.

This invention relates to liquid softener compositions suitable for treatment of all kinds of clothes and/or fabrics, for application in any of the following areas: textile industry, home care, laundromat and similars.

Nowadays, the softeners available in the market are basically solutions or dispersions of dialkylic cationic surfactants, eventually with additives which provides some other benefits for the final products.

BACKGROUND

In U.S. Pat. No. 5,466,394 some softening benefits from combination of cationic and anionic surfactants are described for a predominantly anionic heavy duty laundry detergent. Softening and antistatic effects are also disclosed for a cationic liquid laundry detergent in U.S. Pat. No. 4,264,457, where some specific cationic and anionic surfactants are combined always in the presence of nonionic surfactants.

The invention provides liquid softener compositions, containing anionic surfactants and stoichiometric excess of cationic compounds, that are suitable to make clothes and/or fabrics smoother and softer than those without any treatment after washing process. In general the liquid softener formulations comprise:

a) anionic surfactants of the formula 1:

$$R—O-(AO)_n—SO_3^- \; M^+$$

wherein R is a branched/straight $C_{12}$–$C_{22}$-alkyl/alkenyl or $C_{12}$–$C_{22}$-hydroxyalkyl chain;
O is oxygen;
S is sulphur;
A is —$C_2H_4$— and/or —$C_3H_6$—;
n is a number from 0 to 20 and
M is a cation b) cationic compounds of the formula 2:

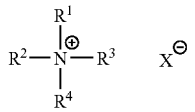

wherein $R^1$ is $C_8$–$C_{22}$-alkyl, $C_8$–$C_{22}$-alkenyl, $R^2$ and $R^3$ are $C_1$–$C_{22}$-alkyl, $C_2$–$C_{22}$-alkenyl,
$R^4$ is a group of the formula -A-$(OA)_n$—OH;
O is oxygen;
H is hydrogen;
N is nitrogen;
A is —$C_2H_4$— and/or —$C_3H_6$—;
n is a number from 0 to 20 and
X is an anion.

c) water for formulation balance;

wherein the cationic compounds and anionic surfactants are present in a weight ratio of 1.5:1 to 19:1 (cationics/anionics).

The alkyl ether sulfates used in the compositions according to the invention are water-soluble salts or acids of the formula $RO(A)_mSO_3M$, in which R is an unsubstituted $C_{12}$–$C_{22}$-alkyl or $C_{12}$–$C_{22}$-hydroxyalkyl radical, preferably a $C_{12}$–$C_{22}$-alkyl or $C_{12}$–$C_{22}$-hydroxyalkyl radical, particularly preferably $C_{12}$–$C_{22}$-alkyl or $C_{12}$–$C_{22}$-hydroxyalkyl radical. "A" is an ethoxy or propoxy unit, m is a number greater than 0, preferably between 0.5 and about 6, particularly preferably between about 0.5 and about 4, and M is a hydrogen atom or a cation, such as, for example, a metal cation (e.g. sodium, potassium, lithium, calcium magnesium, etc.), ammonium or a substituted ammonium cations. Specific examples of substituted ammonium cations are methylammonium, dimethylammonium, trimethylammonium, mono-, di- or triethanolammonium and quaternary ammonium cations, such as tetramethylammonium and dimethylpiperidinium cations, and also those derived from alkylamines, such as ethylamine, diethylamine, triethylamine. Examples of these alkyl ether sulfates which may be mentioned are $C_{12}$–$C_{18}$-alkyl-polyethoxylate (1.0) sulfate, ($C_{12}$–$C_{18}$-E(1.0)M), $C_{12}$–$C_{18}$-alkyl polyethoxylate (2.25) sulfate ($C_{12}$–$C_{18}$-E (2.25)M), $C_{12}$–$C_{18}$-alkyl polyethoxylate (3.0) sulfate, ($C_{12}$–$C_{18}$-E (3.0) M), $C_{12}$–$C_{18}$-alkyl polyethoxylate (4.0) sulfate ($C_{12}$–$C_{18}$-E (4.0) M).

Alkylsulfates which are suitable for this application are water-soluble salts or acids of the formula $ROSO_3M$, in which R is preferably a $C_{12}$–$C_{22}$-hydrocarbon radical, preferably an alkyl or hydroxyalkyl radical having $C_{12}$–$C_{22}$-alkyl components, particularly preferably a $C_{12}$–$C_{18}$-alkyl or hydroxyalkyl radical. M is hydrogen or a cation, e.g. sodium, potassium, lithium or ammonium or substituted ammonium, e.g. methyl-, dimethyl- and trimethylammonium cations and quaternary ammonium cations, such as tetramethylammonium and dimethylpiperidinium cations and quaternary ammonium cations derived from alkylamines, such as ethylamine, diethylamine, triethylamine and mixtures thereof. Instead of alkylsulfates also the corresponding alkenylsulfates may be used or sulfates with mixed alkyl/alkenyl groups.

The amount of anionic surfactant or mixture of anionic surfactants in the claimed compositions is from 0.5 to 20, preferentially from 1 to 15% by weight.

As cationic surfactants of the formula 2 there may be used the following ones, alkyldimethyl-hydroxyethyl-ammonium, alkyldimethyl(poly)alkoxyalkyl-ammonium, dialkylmethyl(poly)-alkoxyalkylammonium. Instead of alkyl these ammonium compounds may also have alkenyl groups or mixtures of both. The alkyl as well as the alkenyl groups may contain 8 to 22 carbon atoms. They may be linear or branched. (Poly)alkoxyalkyl means a group of the formula -A-$(OA)_n$—OH wherein A is ethylene or propylene group or a mixture of both and n is a number of from 0 to 20. Preferably n is zero and A is ethylene that means those compounds and preferred which contain a hydroxyethyl group. Most preferred ammonium compounds are $C_8$–$C_{22}$-alkyl- or alkenyl-dimethyl-hydroxyethyl-ammonium compounds. All mentioned ammonium compounds may contain any kind of anion, the preferred ones are chloride, bromine, acetate, lactate, sulfate or methosulfate.

The claimed compositions may contain these ammonium compounds in an amount from 1 to 40, preferably from 3 to 30% by weight.

Furthermore, the compositions according to the invention may contain 0.1 to 20, preferably 1 to 15% by weight of nonionic and/or amphoteric surfactants. The nonionic or amphoteric surfactants may be alkyl polyalkylene glycol, alkylaryl-polyalkylene glycol, alkyldimethyl amine oxide, di-alkyl methyl amine oxide, alkylamidopropyl amine oxide, alkyl glucamides, alkyl polyglycosides, oxalkylated fatty acids, oxalkylated fatty acid esters, alkyl amines, oxalkylated alkyl amines, alkyl amidopropyl betaines, alkyl dimethyl betaines, alkyl amphoacetates or -diacetates. The alkyl groups of these compounds, which may be partially or fully replaced by alkenyl groups, may contain 8 to 22 carbon atoms and may be linear or branched. The polyalkylene glycol groups may contain 1 to 20 ethoxy and/or propoxy units.

Depending on the intended use, the formulations according to the invention comprise, in addition to said surfactants and water, additives and auxiliaries which are customary and specific in each case, for example solvents, builders, salts, solubilizers, enzymes, thickeners, preservatives, fragrances and dyes, pearlizing agents, emulsifiers and sequestering agents.

Suitable organic and inorganic builders are neutral or, in particular, alkaline salts which are able to precipitate out calcium ions or bind calcium ions to form a complex. Suitable and particularly ecologically acceptable builder substances, such as finely crystalline, synthetic hydrous zeolites preferably the type NaA, which have a calcium-binding capacity in the range from 100 to 200 mg of CaO/g, are used in preference. Zeolite and phyllosilicates can be present in the composition in an amount up to 20% by weight. Organic builders which can be used are, for example, the percarboxylic acids preferably used in the form of their sodium salts, such as citric acid and nitriloacetate (NTA), ethylenediaminetetraacetic acid, provided such a use is not objectionable for ecological reasons. Analogous thereto, it is also possible to use polymeric carboxylates and salts thereof. These include, for example, the salts of homopolymeric or copolymeric polyacrylates, polymethylacrylates and in particular, copolymers of acrylic acid with maleic acid, and also polyvinylpyrrolidone and urethanes. The relative molecular mass of the homopolymers is generally between 1000 and 100,000, that of the copolymers is between 2000 and 200,000, preferably 50,000 to 120,000, based on the free acid, in particular water-soluble polyacrylates which have been crosslinked, for example, with approximately 1% of a sugar polyallyl ether and which have a relative molecular mass above one million are also suitable. Examples thereof are the polymers obtainable under the name Carbopol® 940 and 941. The crosslinked polyacrylates are used in amounts not exceeding 1% by weight, preferably in amounts of from 0.2 to 0.7% by weight. The builder substances can be used in amounts up to 5% by weight.

The desired viscosity of the compositions is adjusted by adding water and/or organic solvents, or by adding a combination of organic solvents and thickeners.

In principle, suitable organic solvents are any mono- or polyhydric alcohols. Preference is given to using alcohols having from 1 to 4 carbon atoms, such as methanol, ethanol, propanol, isopropanol, straight chain and branched butanol, glycerol and mixtures of said alcohols. Other preferred alcohols are polyethylene glycols having a relative molecular mass below 2000. In particular, the use of polyethylene glycol having a relative molecular mass between 200 and 600 and in amounts up to 45% by weight, and of polyethylene glycol having a relative molecular mass between 400 and 600 in amounts from 5 to 25% by weight is preferred. Also the lower alkyl ether of ethylenglycol, lower alkyl ether of propylenglycol, propylenglycol, polyethylenglycol and polypropylenglycol can be used. An advantageous mixture of solvents consists of a monomeric alcohol, for example ethanol and polyethylene glycol in the ratio 0.5:1 to 1.2:1.

Other suitable solvents are, for example, triacetin (glycerol triacetate) and 1-methoxy-2-propanol.

Preferred thickeners are hydrogenated castor oil, salts of long-chain fatty acids, which are preferably used in amounts of from 0 to 5% by weight and in particular in amounts from 0.5 to 2% by weight, for example sodium, potassium, aluminium, magnesium and titanium stearates or the sodium and/or potassium salts of behenic acid, and polysaccharides, in particular xanthan gum, guar guar, agar agar, alginates and tyloses, carboxymethylcellulose and hydroxyethylcellulose, and also relatively high molecular weight polyethylene glycol mono- and -diesters of fatty acids, polyacrylates, polyvinyl alcohol and polyvinylpyrrolidone, and also electrolytes such as sodium chloride and ammonium chloride Suitable enzymes are those from the class of proteases, lipases, amylases and their mixture. Their proportion can be from 0.2 to 1% by weight. The enzymes can be adsorbed to carrier substances and/or embedded into coating substances.

Suitable preservatives are, for example, phenoxyethanol, formaldehyde solution, pentanediol or sorbic acid.

Suitable pearlizing agents are, for example, glycerol distearic esters such as ethylene glycol distearate, but also fatty acid monoglycol esters.

Suitable salts or extenders are, for example, sodium sulfate, sodium carbonate, ammonium chloride, magnesium chloride, sodium chloride, sodium tripolyphosphate, sodium silicate (water glass) or magnesium sulfate.

Typical individual examples of other additives are sodium borate, starch, sucrose, polydextrose, RAED, stilbene compounds, methylcellulose, toluenesulfonate, cumenesulfonate, xylenesulfonate, soaps and silicones.

The products according to the invention are notable for good storage stability and also softening performance.

The examples below serve to illustrate the invention in more detail without limiting it thereto. All amounts are given as % (w/w).

EXAMPLES

I) Liquid Softener

A) 35.0 $C_{12}/C_{14}$-Alkyl dimethyl hydroxyethyl ammonium chloride (40% a.m.) (Praepagen HY®)

B) 31.6 Sodium $C_{16}/C_{18}$-alkyl sulphate (19% a.m.) (Flotinor S072®)

C) 0.1 Hydroxiethylidene di-phosphonic acid (100% a.m.) (Sequest HEDP®)

D) 3.0 Ethanol

E) Water qsp 100

F) Perfume qs

G) Colorant qs

H) Preservant qs

Procedure:

I. Mix at room temperature A+B+E

II. Add D and mix

III. Add C and mix

IV. Add F+G+H and mix

II) Liquid Softener

A) 33.5 $C_{12}/C_{14}$-Alkyl dimethyl hydroxyethyl ammonium chloride (40% a.m.) (Praepagen HY®)

B) 31.7 Sodium $C_{16}/C_{18}$-alkyl sulphate (19% a.m.) (Flotinor S072®)

C) 1.0 Ethoxylated alkyl amine (100% a.m.) (Genamin T120®)

D) 0.1 Hydroxiethylidene di-phosphonic acid (100% a.m.) (Sequest HEDP®)

E) 5.0 Ethanol

F) Water qsp 100

G) Perfume qs

H) Colorant qs
I) Preservant qs

Procedure:
I. Mix at room temperature A+B+F
II. Add E and mix
III. Add C and mix
IV. Add D and mix
IV. Add G+H+I and mix III) Liquid Softener
A) 18.8 $C_{12}/C_{14}$-Alkyl dimethyl hydroxyethyl ammonium chloride (40% a.m.) (Praepagen HY®)
B) 18.8 $C_{12}/C_{18}$-Alkyl dimethyl hydroxyethyl ammonium chloride (40% a.m.)
C) 26.3 Sodium $C_{16}/C_{18}$-alkyl sulphate (19% a.m.) (Flotinor S072®)
D) 0.1 Hydroxiethylidene di-phosphonic acid (100% a.m.) (Sequest HEDP®)
E) Water qsp 100
F) Perfume qs
G) Colorant qs
H) Preservant qs Procedure:
I. Mix at room temperature A+C+E
II. Add B and mix
III. Add D and mix
IV. Add F+G+H and mix IV) Liquid Softener
A) 26.3 $C_{12}/C_{14}$-Alkyl dimethyl hydroxyethyl ammonium chloride (40% a.m.) (Praepagen HY®)
B) 11.2 $C_{12}/C_{18}$-Alkyl dimethyl hydroxyethyl ammonium chloride (40% a.m.)
C) 26.3 Sodium $C_{16}/C_{18}$-alkyl sulphate (19% a.m.) (Flotinor S072®)
D) Water qsp 100
E) Perfume qs
F) Colorant qs
G) Preservant qs Procedure:
I. Mix at room temperature A+C+D
II. Add B and mix
III. Add E+F+G and mix

The invention claimed is:

1. A liquid softener composition consisting of:

a) from 0.5 to 20% by weight of an anionic surfactant of the formula:

$$R—O-(AO)_n—SO_3^- M^+$$

wherein R is a branched/straight $C_{12}$–$C_{22}$-alkyl/alkenyl or $C_{12}$–$C_{22}$-hydroxyalkyl chain;
O is oxygen;
S is sulphur;
A is —$C_2H_4$— and/or —$C_3H_6$—;
n is a number from 0 to 20 and
M is a cation b) a cationic compound of the formula:

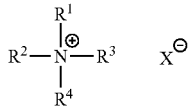

wherein $R^1$ is $C_8$–$C_{22}$-alkyl, $C_8$–$C_{22}$-alkenyl, $R^2$ and $R^3$ are $C_1$–$C_{22}$-alkyl, $C_2$–$C_{22}$-alkenyl,
$R^4$ is a group of the formula -A-$(OA)_n$—OH;
O is oxygen;
H is hydrogen;
N is nitrogen;
A is —$C_2H_4$— and/or —$C_3H_6$—;
n is a number from 0 to 20 and
X is an anion.

c) an amphoteric surfactant;
d) water for formulation balance;
e) one or more component selected from the group consisting of solvents, complexing agents, additives, auxiliaries, adjuvants, and mixtures thereof; and wherein the cationic compound and anionic surfactant are present in a weight ratio of cationic compound b) to anionic surfactant a) of 1.5:1 to 19:1.

2. A liquid softener as claimed in claim 1, wherein the cationic compound is selected from the group consisting of one or more $C_8$–$C_{22}$-alkyl-dimethyl-hydroxy-ethyl ammonium compound, one or more $C_8$–$C_{22}$-alkenyl-dimethyl-hydroxy-ethyl ammonium compound, and mixtures thereof.

3. A liquid softener as claimed in claim 1, wherein the cationic compound is present in an amount of from 1 to 40% by weight.

4. The liquid softener as claimed in claim 1, wherein amphoteric surfactant c) is from 0.1 to 20% by weight of the liquid softener.

5. The liquid softener as claimed in claim 1, one or more component e) is a solvent selected from the group consisting of alcohols, lower alkyl ethers of ethylene glycol, lower alkyl ethers of propylene glycol, ethylene glycol, propylene glycol, polyethylene glycol polypropylene glycol, aliphatic hydrocarbons, aromatic hydrocarbons, and mixtures thereof.

6. The liquid softener as claimed in claim 1, wherein the complexing agents are selected from the group consisting of EDTA, aminotrimethylene-phosphonic acid, 1-hydroxyethylidene-1,1-diphosphonic acid, diethylenetriaminepentamethylene-phosphonic acid, and mixtures thereof.

7. The liquid softener as claimed in claim 1 wherein the anionic surfactant ranges from 1 to 15% by weight of the liquid softener.

8. The liquid softener as claimed in claim 1 wherein the cationic compound is present in an amount of from 3 to 30% by weight.

9. The liquid softener as claimed in claim 1 wherein the auxiliaries are selected from the group consisting of solvents, builders, salts, solubilizers, enzymes, thickeners, preservatives, fragrances and dyes, pearlizing agents, emulsifiers, sequestering agents, and mixtures thereof.

* * * * *